US005269616A

United States Patent [19]

O'Neill

[11] Patent Number: 5,269,616

[45] Date of Patent: Dec. 14, 1993

[54] RING BINDER STABILIZER DEVICE

[75] Inventor: Joseph M. O'Neill, Darien, Ill.

[73] Assignee: Acco USA, Inc., Wheeling, Ill.

[21] Appl. No.: 876,649

[22] Filed: Apr. 30, 1992

[51] Int. Cl.[5] ..... B42F 13/12

[52] U.S. Cl. ..... 402/74; 402/78

[58] Field of Search ..... 402/80 R, 80 P, 78, 402/74

[56] References Cited

U.S. PATENT DOCUMENTS 4,582,442 4/1986 Rager ..... 402/80 P

FOREIGN PATENT DOCUMENTS 1316295 12/1989 Japan ..... 402/80 R

*Primary Examiner*—Paul A. Bell

*Assistant Examiner*—Kenneth J. Hansen

*Attorney, Agent, or Firm*—Pennie & Edmonds

[57] ABSTRACT

A stabilizer device positioned between the ring mechanism and the cover of a ring binder. The ring mechanism has a depending extension for bearing against the stabilizer device.

3 Claims, 2 Drawing Sheets

RING BINDER STABILIZER DEVICE

BACKGROUND OF THE INVENTION

While various binder constructions have been proposed including use of flat plates or curved plate portions (U.S. Pat. Nos. 1,915,140 and 3,809,485), heretofore no simple inexpensive construction to improve stability of the binder has been found.

SUMMARY OF THE INVENTION

Broadly, the invention is a stabilizer device positioned between the ring mechanism and the cover to increase the stability of the ring mechanism vis-a-vis the cover when they are secured together. The ring mechanism has an depending extension with a bearing surface for bearing against the stabilizer device which device engages the cover.

It is a feature that the stabilizer device is an elongated plastic base piece with stiffening members.

DESCRIPTION OF THE PREFERRED EMBODIMENT

Figure 1:
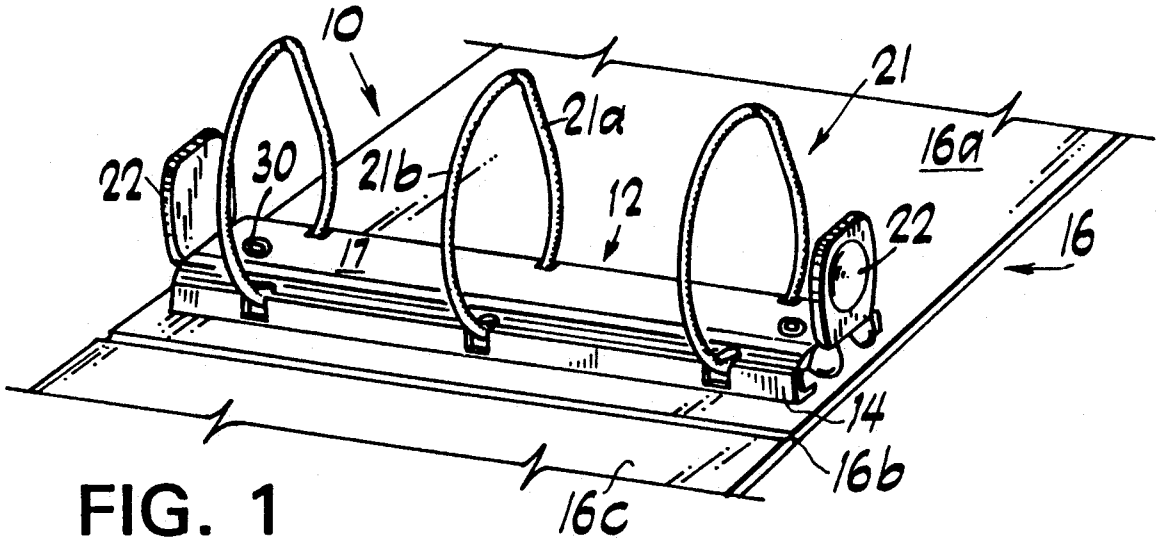
FIG. 1 is a perspective view of a ring binder having a stabilizer device of the present invention.
Figure 2:
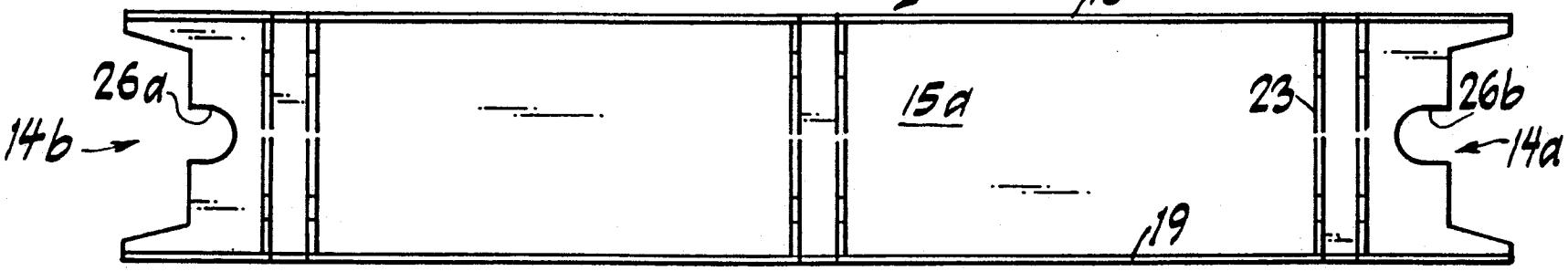
FIG. 2 is an enlarged plan view of the stabilizer element.

In the Figures, binder 10 includes binder mechanism 12, stabilizer device 14 and cover 16. Binder mechanism 12 includes arcuate casing 17, hinge plates (not shown) and rings 21 comprised of ring halves 21*a*, 21*b* and triggers 22. Cover 16 includes cover portion 16*a*, hinge 16*b* and cover portion 16*c*.

Figure 3:
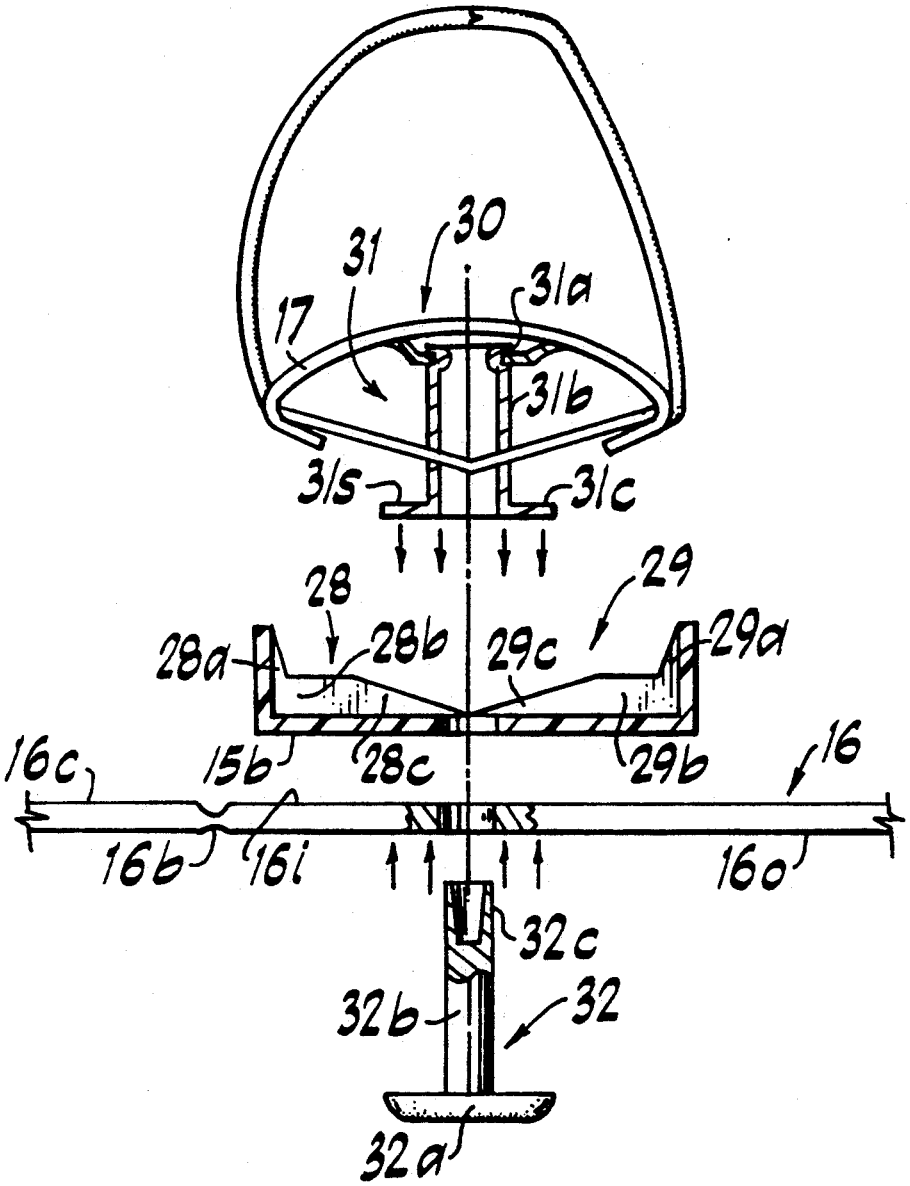
FIG. 3 is an enlarged partial elevational exploded view of the binder including the stabilizer element.

Stabilizer device 14 comprises an elongated base piece 15 with upper interior surface 15*a* and outside exterior surface 15*b*, upstanding elongated sides 18, 19, six (6) spaced apart rib strengthening pieces 23 connected to base piece 15 and sides 18, 19 to strengthen and make more rigid the stabilizer device 14. Each rib piece 23 includes right and left webs 28, 29, each with outside steeply sloping portion 28*a*, 29*a*, horizontal intermediate portion 28*b*, 29*b* and outer sloping portion 28*c*, 29*c*. (FIG. 3). Each end portion 14*a*, 14*b* of device 14 has curved openings 26*a*, 26*b*. Device 14 is preferably made of a stiff plastic material.

Turning to FIG. 3, the assembly and attachment of the binder parts is accomplished by assemblies each comprising a tubular housing 31 and a rivet 32. Each tubular housing 31 includes an upper flared portion 31*a* welded around an opening 30 in casing 17, a central stem portion 31*b* and a lower annular seating portion 31*c*. Depending from arcuate casing 17 housing 31 is a downward extension of casing 17 which is seated against the interior surface 15*a* of base piece 15 of device 14 which causes outside surface 15*b* of piece 15 to be seated against the inside surface 16*i* of cover 16. Rivet 32 with outside head 32*a*, stem 32*b*, and deformable head 32*c* is positioned through housing stem 31*b* and its head 32*c* deformed to secure the binder parts together.

Stabilizer device 14 increases the stability in that the forces between cover surface 16*o* of cover 16 area (indicated by arrows pointing up in FIG. 3) upon which the ring mechanism would seat, if device 14 were absent, are spread over a large area by the intermediate device 14 reducing movement arm forces or torques which cause the ring binder mechanism 12 to move with respect to cover 16 during binder 10 operation and handling. Arrows pointing down in FIG. 3 indicate forces exerted by depending housing 31 against device 14 when assembly is complete.

I claim:

1. In a ring binder including an elongated ring mechanism and a cover, the improvement comprising ring mechanism depending tubular housing means connected to the ring binder mechanism, an elongated stabilizing device having an upper surface and a lower surface with a first opening extending therethrough from said upper surface to said lower surface said device positioned between the tubular housing means with a second opening therethrough and the cover having a third opening therethrough, and clamping fastener means positioned through said three (3) openings to urge the tubular housing means against the stabilizer device which in turn is urged against the cover.

2. The ring binder of claim 1 in which the stabilizer device includes an elongated plastic base piece with transverse strengthening ribs.

3. The ring binder of claim 1 in which said stabilizing device is substantially the length of the ring mechanism, in which the elongated stabilizing device and cover have a plurality of spaced-apart aligned openings with a mechanism depending tubular housing means opening adjacent each such aligned pairs of openings and clamping fastener means positioned through each pair of openings and tubular housing means opening.

* * * * *